US005716063A

United States Patent [19]

Doyle et al.

[11] Patent Number: 5,716,063

[45] Date of Patent: Feb. 10, 1998

[54] WALKING AID

[75] Inventors: Brian Peter Doyle, Toronto; Geoffrey Roy Fernie, Islington, both of Canada

[73] Assignee: CSIA Research Foundation, Toronto, Canada

[21] Appl. No.: 407,097

[22] Filed: Mar. 20, 1995

[51] Int. Cl.[6] ..... A61H 3/04

[52] U.S. Cl. ..... 280/87.05; 74/502.2; 135/67; 188/2 D; 280/87.041; 297/5

[58] Field of Search ..... 280/87.041, 87.05, 280/87.21, 641, 642, 649, 650, 657, 47.35, 47.38; 74/502.6, 502.2, 501.6; 482/66, 68; 135/67; 188/2 D, 24.22, 265; 297/111, 105, 129, 134, 188.01, 188.08, 188.09, 188.12, 223, 1, 4, 5, 6, 188.2, 256.16, 219.1

[56] References Cited

U.S. PATENT DOCUMENTS

| | | | |
|---|---|---|---|
| D. 177,922 | 6/1956 | Orsborn | 297/188.08 |
| 499,032 | 6/1893 | Parnelli | 482/68 |
| 671,771 | 4/1901 | Macker | 297/188.12 |
| 2,987,109 | 6/1961 | Sohmer | 297/188.12 |
| 3,637,232 | 1/1972 | Bourgraf et al. | 280/641 |
| 3,872,945 | 3/1975 | Hickman et al. | 297/5 |
| 4,146,265 | 3/1979 | Ocel et al. | 297/188.12 |
| 4,211,309 | 7/1980 | Ruggiero | 188/83 |
| 4,461,471 | 7/1984 | Brastow | 482/68 |
| 4,813,701 | 3/1989 | Balland | 280/641 |
| 4,867,438 | 9/1989 | Steckert et al. | 135/67 |
| 4,907,794 | 3/1990 | Rose | 482/68 |
| 5,020,560 | 6/1991 | Turbeville | 135/67 |
| 5,054,851 | 10/1991 | Chiu | 297/5 |
| 5,076,405 | 12/1991 | Modica | 297/188.1 |
| 5,351,700 | 10/1994 | Jones | 280/87.021 |
| 5,409,028 | 4/1995 | Lee | 135/67 |
| 5,464,235 | 11/1995 | Goldman et al. | 188/2 D |

FOREIGN PATENT DOCUMENTS

| | | | |
|---|---|---|---|
| 2056148 | 5/1993 | Canada | 135/67 |
| 94020058 | 9/1994 | WIPO | 135/67 |

*Primary Examiner*—Anne Marie Boehler

[57] ABSTRACT

A walking aid for physically challenged persons having front and back leg assemblies each having a front leg extending forwardly and a rear leg extending rearwardly and wheels at the lower ends of the legs, and modular hinges at the upper ends of each pair of legs. Each modular hinge has a bearing housing with bearing recesses, two bearing bodies, each bearing body being received in a respective recess. Each bearing body is interengagable with a respective front or rear leg, and, a transverse assembly bar is connected to the hinge mounting and secures the hinges in spaced apart side by side relation. Also disclosed is a brake locking system for an in-line two part brake handle, and a multi-use seat for a walker.

16 Claims, 5 Drawing Sheets

WALKING AID

FIELD OF THE INVENTION

The invention relates to a walking aid for use by physically challenged persons either when walking, or when seated.

BACKGROUND OF THE INVENTION

Walking aids are well-known for assisting physically challenged persons to make them more mobile and independent. The majority or such walking aids are based upon some form of scissors type framework of bent and welded tubes and having wheels at the lower ends and some form of hand grips at the upper end. Brakes are commonly provided for retarding the walking aid. Some of these walking aids also incorporate supports for parcels and still others of these walking aids are capable of being collapsed by folding these scissors arms together for stowing in a car, or for storage in a dwelling.

All of these various functions and characteristics are desirable in such a walking aid, but in the past they have not always been provided in the most satisfactory manner. For example, the braking mechanism on many of these walking aids involved relatively agile manipulation of the hands and fingers, to operate the brake handle. However, in U.S. Pat. No. 5,348,336 dated Sep. 20, 1994, Title: Walking Aid, Inventors: Geoffrey R. Fernie et al., there is disclosed a walking aid having an improved braking mechanism operable simply by arm and hand movements, without requiring manipulation of the fingers. This itself was a significant improvement over earlier forms of braking mechanisms. In addition, in the aforesaid U.S. Patent, there was disclosed a seating platform. The seating platform enabled the user to as it were, turn the walker around, and to sit on a platform, while resting, or for example, while watching an event. This feature provided an extra degree of utility to the walking aid. In addition, the aforesaid U.S. Patent disclosed a walking aid based on the scissor arm principle, in which two pairs of scissor arms were cross linked side by side by collapsible links. In this way, the walker could be collapsed by folding the scissors arms together, in the forward and rearward direction, and also further collapsing by folding the cross links together. This provide for a more compact stored form of walker having adjustable width in use, and further added to the utility of the design.

It has, however, been determined that still further improvements and modifications can be made which produce desirable features, and provide for still greater utility and variation in use.

For example, the design of walker in the aforesaid U.S. Patent, using the foldable crosslinks between the side arm, somewhat restricted its use both as a walking aid and also more particularly as a tray. In this case, a person may sit down on a chair, and pull the walking aid towards themselves, drawing the seat over the knees. The seat then functions as a tray. When used as a walking aid, most persons would not find the crosslinks inconvenient. In this case of use as a tray, the crosslinks tended to interfere. When the person sits down on a seat, the tray provided by the walking aid is pulled over the knees. In the earlier designs the existence of the crosslinks tended to interfere with this positioning of the feet and legs underneath the tray, and thus somewhat reduced its utility as a tray.

It is desirable to provide a construction in which the crosslinking mechanism is avoided.

A further factor in the design is that in the design of earlier walkers it was necessary to have completely different frames in order to provide for adjustability in height. The need to provide for many sizes in such walkers for tall persons, or for children, has tended to increase the cost.

Most earlier walkers used tubes which were bent at angles, and hinged by simple bolts passing through the tubes. This tended to make them somewhat loose and unsteady.

It is desirable, in order to facilitate distribution and sale of such walkers that the design shall be as compact as possible for shipping and storage. In addition, a modular design in which various standard components can be assembled with different sub-components to produce a variety of designs is desirable, but has generally speaking not been achieved in the past. There is also a requirement for a more rugged design capable of withstanding considerable use, without becoming loose, which is another desirable factor, which was not always achieved in earlier designs.

Another desirable factor in such a walker especially one that will be used for seating or as a tray, is the provision of a brake-locking mechanism that requires no manual dexterity for its use. Such a brake-locking mechanism will enable the brakes to be applied and locked on when, for example, a person is seated on the walker. This will then give greater security to the person, since the walker cannot roll away.

Another factor adding still greater versatility, is the provision of a seat on the walker which can also act as a platform or support for parcels or which can be used as a tray and which incorporates attachment means for hanging parcels, without adversely affecting the stability of the walker.

BRIEF SUMMARY OF THE INVENTION

With a view, therefore, to providing an improved walking aid, the invention comprises a walking aid for physically challenged persons and comprising two front and back leg assemblies, each leg assembly having a front leg extending forwardly and a rear leg extending rearwardly and wheel means at the lower ends of the legs, and modular hinge means at the upper ends of each said pair of legs, each said modular hinge means having a bearing housing means defining two generally semi-circular bearing recesses, spaced apart from one another and defining separate axes of rotation, two bearing body means, each said bearing body means being received in a respective said recess, connection means on each said bearing body, interengagable with a respective said one of said front and rear leg means, a pair of upwardly extending steering arm means, one of said bearing bodies incorporating attachment means for attachment of a respective one of said steering arm means thereto, and, transverse assembly bar means, defining two ends, a said end being connected to a respective one said hinge mean, thereby mounting and securing said hinge mean in spaced apart side by side relation.

The invention further provides a walking aid wherein the transverse assembly bar is provided with releasable fastening means at each end, whereby the same may be dismantled and released from said hinge means for shipping.

The invention further provides a walking aid wherein the hinge mean include a bearing frame supporting the bearing housing, and defining a forward and rearward axis, and a connecting boss formed on said mounting frame, extending normal to said longitudinal axis, for connecting with said assembly bar.

A further embodiment of the invention provides a walking aid having a braking means in which the walking handles are of two part construction, one part of each handle being moveable to apply the brakes and including brake locking means on a fixed part of the handle for locking the brakes when they are applied, and being manually releasable.

The invention further provides a walking aid with a back support bar connected to each said hinge means and extending transversely across said walking aid, for supporting the back of a person when seated on the seat.

The invention also provides a seat for such a walking aid, having a recess for receiving articles and padding means moveable attached to said seat, and adapted to be placed in said recess means for seating, and suspension means on said seat for suspending articles therefrom and which can also be used as a tray.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
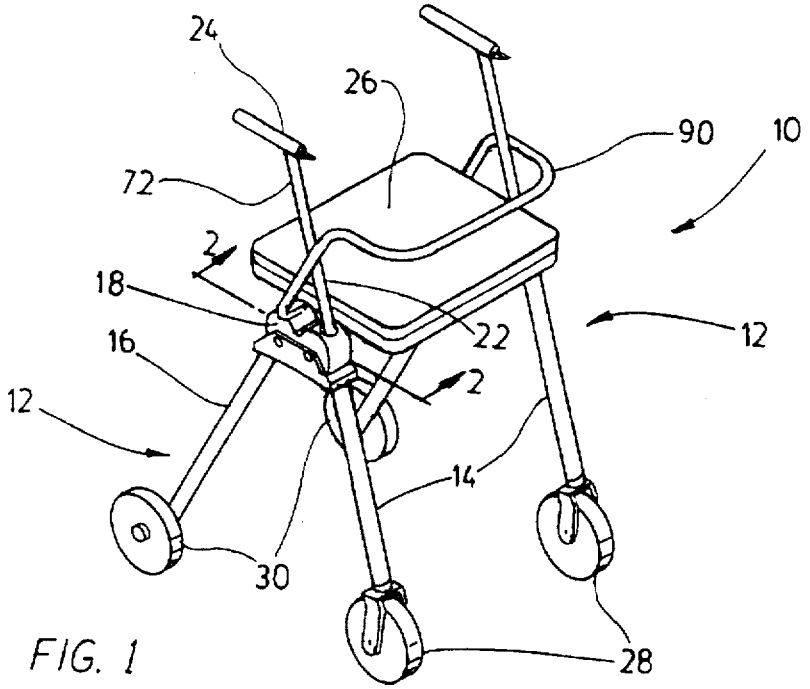
FIG. 1 is a general perspective of an embodiment of walking aid illustrating the invention.

Referring first of all to FIG. 1, it will be seen that what is there shown, by way of illustrating the invention, is an embodiment of a walking aid indicated generally as 10. The walking aid 10 has two scissors-leg assemblies indicated as 12—12. Each of the leg assemblies consists of forward and rear legs 14 and 16. Each pair of forward and rear legs is connected to a hinge assembly 18. The two hinge assemblies are cross connected by means of a transverse assembly bar 20 in side by side spaced apart relation.

Guide handbars 22 extend upwardly from the hinge assemblies, and have more or less horizontal handle portions 24, which can be grasped by the user.

A seat 26 (partially cut away) is provided between the two leg assemblies. Front and rear wheels 28 and 30 and located at the lower ends of the legs. The front wheels 28 are provided with a caster action mounting for steering.

Figure 2:
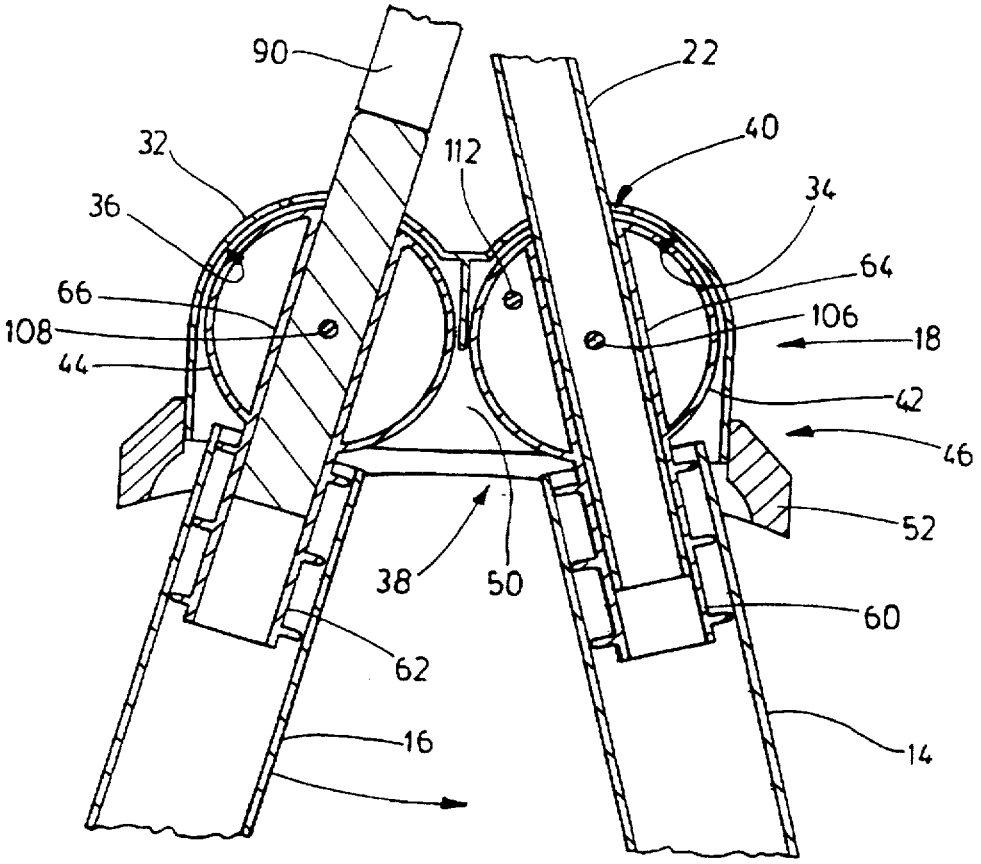
FIG. 2 is a section along line 2—2 of FIG. 1, of the modular hinge assembly
Figure 3:
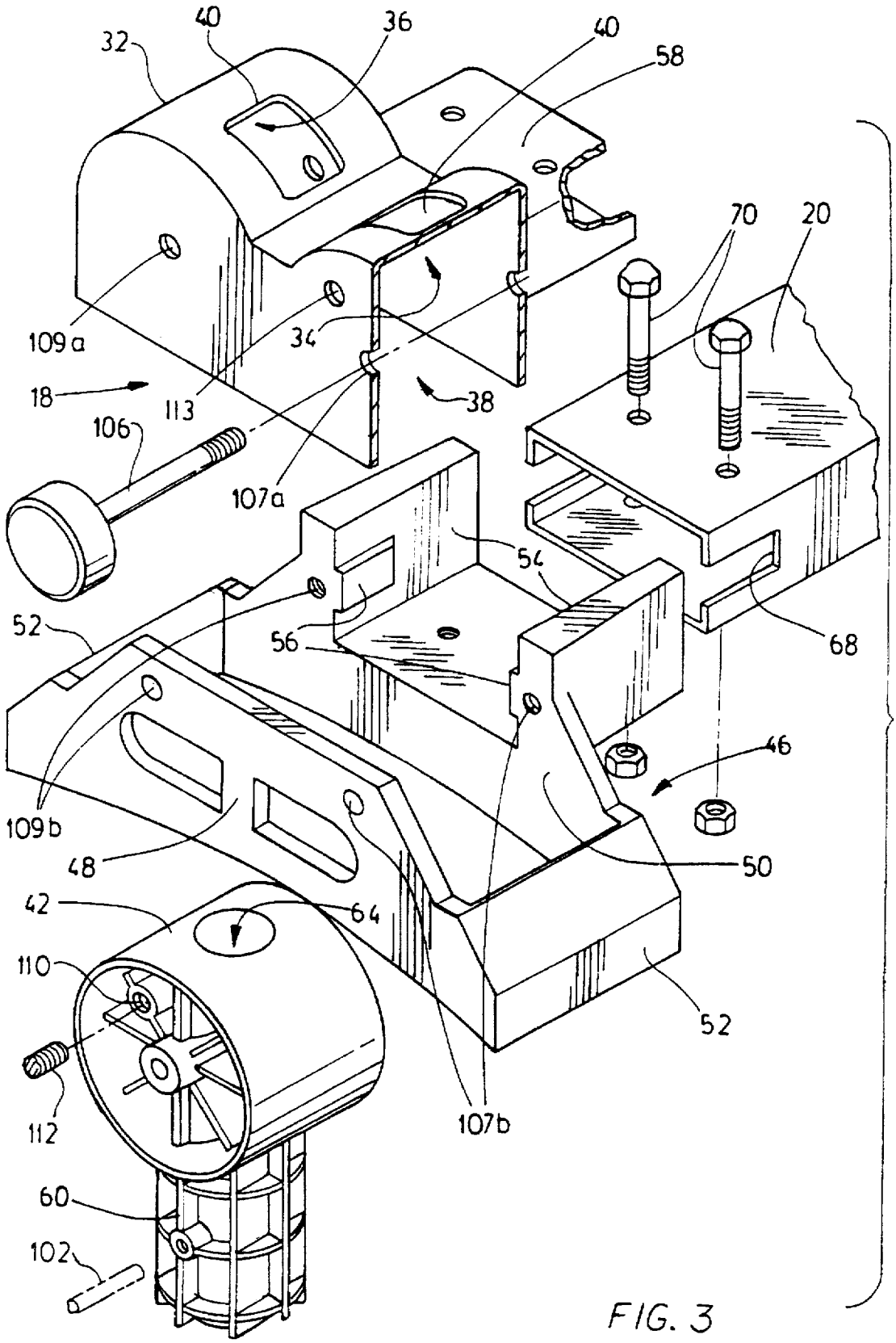
FIG. 3 is an exploded perspective view of the modular hinge assembly and transverse assembly bar.
Figure 4:
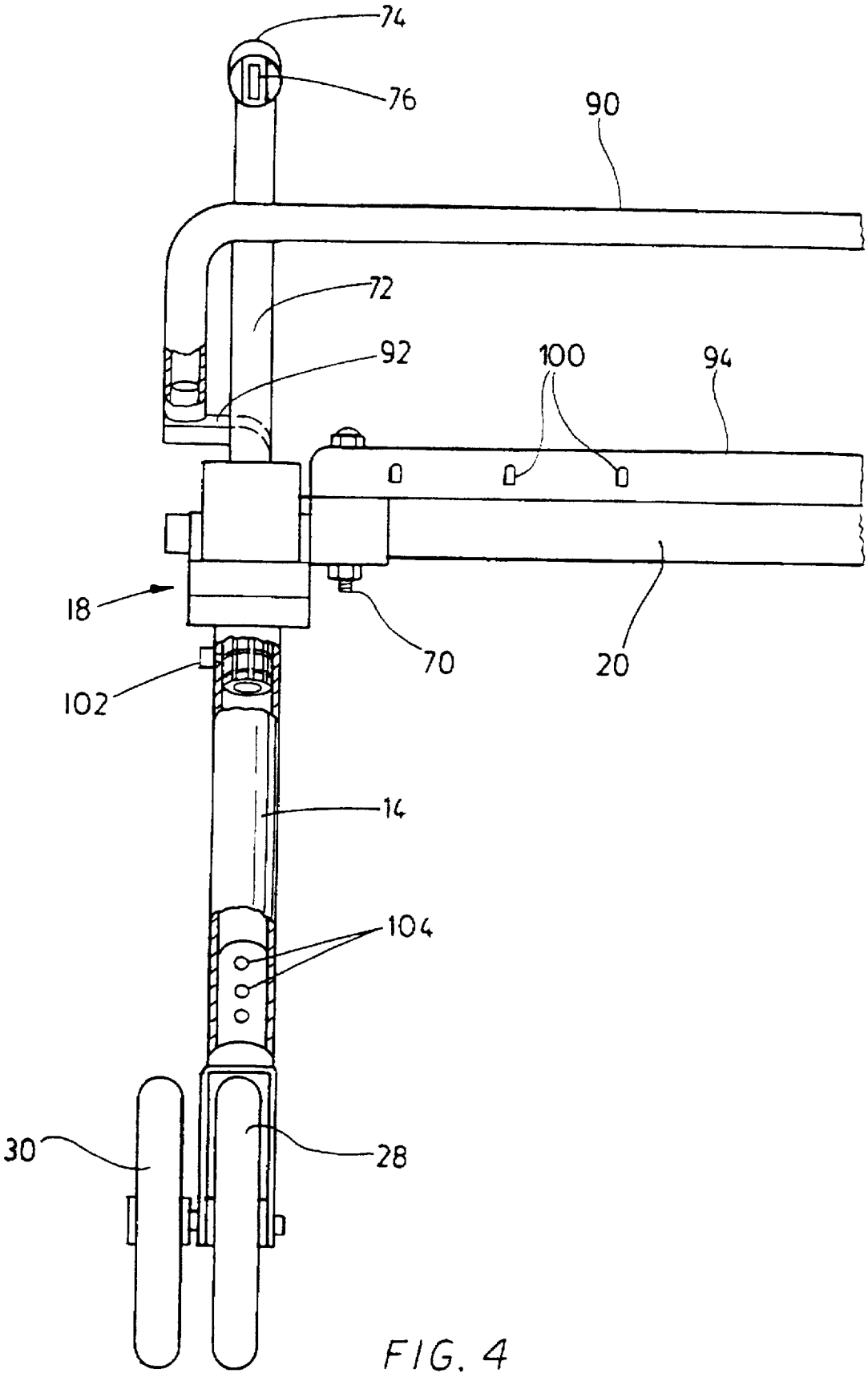
FIG. 4 is a rear elevation of one side of the walking aid.

Referring now to FIG. 2, each of the hinge assemblies will be seen to comprise a bearing housing 32 having two spaced apart bearing recesses 34 and 36 formed therein. The lower portions 38 of the bearing housing recesses are open, downwardly. In addition, each of the bearing recesses has a generally upper elongated opening 40 formed therein.

Bearing bodies 42 and 44 are formed so as to fit within the bearing recesses 34 and 36. The recesses and bodies are of generally semi-cylindrical shape, so that the bearing bodies can rotate within their respective recesses, to provide a folding action to the walking aid, as described below. Each of the bearing housings 32 is received in a respective hinge mounting frame 46, which is of more or less rectangular shape in plan, and defines two side walls 48 and 50, and end walls 52, defining an open spacing for receiving the respective bearing housing 32 therein.

The outwardly facing surface of the wall 48 of the hinge frame 46 is smooth. The inwardly facing wall 50 of the hinge frame 46 is formed with receiving shoe walls 54 defining a rectangular spacing therebetween for reasons to be described below. Abutments 56 are formed on walls 54.

Bearing housings 32 are formed with transverse connecting stubs 58 fitting within shoes 54 and defining a spacing therebetween.

Each of the bearing bodies 42 and 44 is formed with an integral leg mounting boss 60 and 62 respectively. The leg bosses consist essentially of cylindrical bodies formed integrally with the bearing bodies, and extending outwardly therefrom substantially in a radial manner. In this way the legs can be attached to the bodies in a manner described below, to provide the legs with a hinging action, for folding closed and opened.

Each of the bearing bodies is also formed with, in this case, a generally cylindrical recess 64 and 66 for receiving components to be described below.

In order to join the two hinge assemblies 18, 18 together, the transverse assembly bar 20 is provided. Assembly bar 20 is of generally rectangular hollow cross-section. It is shaped to fit over the stubs 58 of the bearing housings 32 in each of the hinge assemblies 18 and to be snugly received in each of the shoes 54 of the hinge assembly frames 46. Slots 68 fit over abutment 56. Fastening means such as bolts 70 can be used to secure the two ends of the assembly bar to the respective stubs 58 and shoes 54.

In this way, a rigid transverse junction is provided between the two hinge assemblies 18 securing them in a rigid stress resistant manner, without the requirement for additional cross bracing between the legs, which was usually shown in earlier walking aid designs.

For ease of shipment, the assembly bar 20 can be dismantled from the two hinge assemblies 18, so that in fact the entire walking aid can be shipped in a relatively small container in a knocked down kit form. It can then be assembled on site by the distributor or vendor.

In order for the user to hold and guide the walker, and to obtain support from it while walking, upwardly extending hand bars 72 are provided, connected to the forward bearing bodies 42, in each of the hinge assemblies 18. The hand bars 72 thus extend essentially co-axial with the front legs 14 of the walker and extend slightly rearwardly over the rear wheels 30. The handbars are adjustable in height. Several holes at spacings along the length of handbars 72 can be selected for attachment, using thumbscrew 106 which also forms the axis of rotation for the hinge.

Each of the handbars 72 is provided with a rearwardly extending more or less horizontal handle 74, which is rigid and fixed in angle in relation to the handbar 72. This enables the user to grasp two handles 74, and guide the walker, in the desired direction. In order to operate the brakes (not shown) which control at least one pair of wheels, movable brake bars 76 are swingably connected to free ends of the handles 74.

Figures 5, 6:
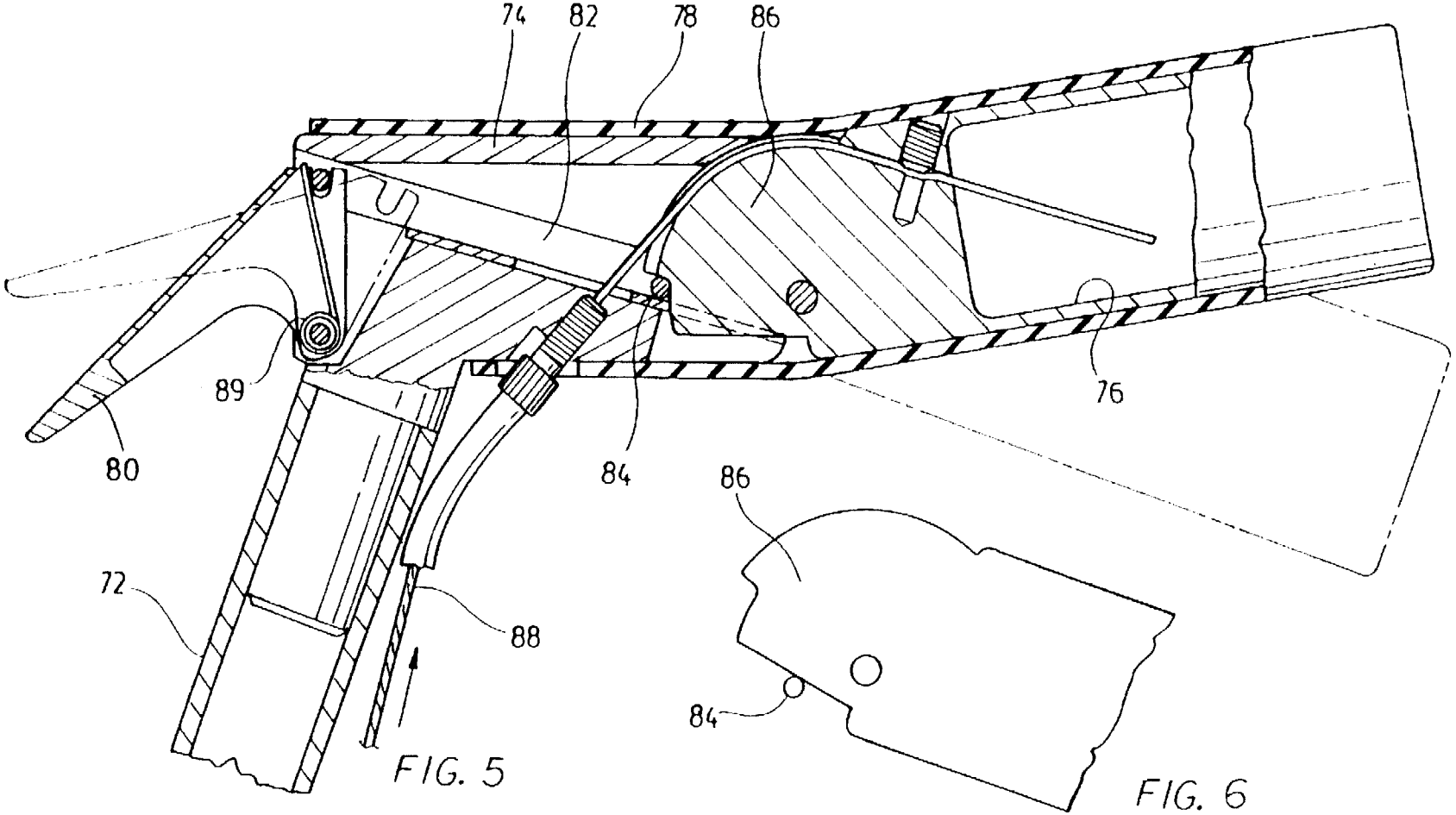
FIG. 5 is a section along line 5—5 of FIG. 1 illustrating the handle and brake, and showing movement in phantom.
FIG. 6 is a view corresponding to FIG. 5 showing the movement of the brake locking mechanism.

The moveable brake bars operate the brakes, by being pressed downwardly with a downward swinging action (FIG. 5).

The handles, and their associated brake bars, are enclosed within flexible padded sleeves 78 which enable the user to either grasp the rigid handles 74, or simply slide their hands back to grasp the brake bars 76, as desired.

It is desirable to provide for a brake locking action, so that it is not necessary for the user to hold the brake bars 76 down, continuously. Such a brake locking action is achieved by means of the locking lever 80, secured to one of the two handles 74. The locking lever 80 is pivotally mounted, and can be swung up to lock the brakes, and swung down to release them. Any suitable holding mechanisms such as slide bar 82 having stop 84 or the like can be used to hold the brake closed, or opened. A locking cam 86 is formed on one of brake bars 76 with a stop 84. Cable 88 operates the brakes.

A torsion spring 89 on lever 80 holds the brake engaged until downward pressure on the lever 80 pulls the slide bar 82 back and releases the brake.

Brake release springs (not shown) is provided at the ends of the brake cables.

In order to further connect the hinge assemblies, a back bar 90 is provided, of generally wide U-shape. The back bar 90 defines two parallel connection stubs 92. The connection stubs fit in recesses 66 in the rearward ones of bearing bodies 44. The back bar 90 is also shaped so as to provide a form of back rest, for a person who is seated on the seat.

For this purpose, it is shaped in such a way that it extends forwardly with respect to the hinge assemblies 18. The two stubs 92 are shaped in such a way that they extend outwardly with respect to the handbars 72, having inturned ends, fitting in the rearward bearing bodies 44.

The seat 94 is plastic panel shaped with a recess 96 for receiving articles. It is secured to the hinge assemblies 18 by bolts 70.

A seat pad is swingably attached along an edge of the seat 94, and can be swung upwardly and rearwardly to fill the recess, when the seat is used for seating. Alternatively the seat pad is held in place by straps (not shown) passing around the assembly bar.

The seat is also provided with a number of hooks 100 along its leading edge, from which various articles such as bags can be suspended.

The upper ends of the legs are secured by fastenings 102 to the bearing bodies 42, 44 and can thus be easily assembled by a distributor or vendor.

The legs can be supplied in a variety of lengths, to suit persons of different height, and ability.

In addition, minor adjustments in height can be effected by means of adjusting the fastening of the wheels to the lower ends of the legs, by fastening means 104. This allows minor adjustments in wheel height to be effected, where necessary to level all four wheels.

The assembly bar 20 is secured by means of bolts 70 which pass through the stubs 58 and through the shoes 54. They are readily accessible from below and, can easily be tightened up and secured by a vendor or a distributor.

The hinge assemblies 18 are held together by means of two fastenings 106 and 108, which pass completely through the frames 46, and through the bearing housings 32, and through the bearing bodies 42 and 44.

The front legs use thumbscrew 106 to allow the handle height to be easily changed. The back legs use an ordinary bolt 108 since nothing is adjustable in this location bolts 160 pass through holes 107A and B, bolts 108 pass through holes 109A and B. Note that front bearing body 42 has an offset hole 110. A locking bolt 112 passes and hole 113 in order to firmly fix the front legs and prevent folding when bumping into an obstruction. It also holds everything in alignment when bolt 106 is withdrawn to adjust height of handle.

The walker folds by swings the back legs (connected by the back rest) toward the fixed front legs. The plastic bearing surfaces are shaped with abutments (not shown) to provide a "click" in place action to hold them in the folded position.

An important feature is the ability to produce walkers for children and for oversized adults simply by selecting leg tubes of different lengths to vary seat height and horizontal tubes of different lengths to vary width.

This modular approach also allows substitution of centre sections of different designs for specific purposes (e.g. push-chair seats, mail man carrying baskets and adjustable width mechanisms).

Figure 7:
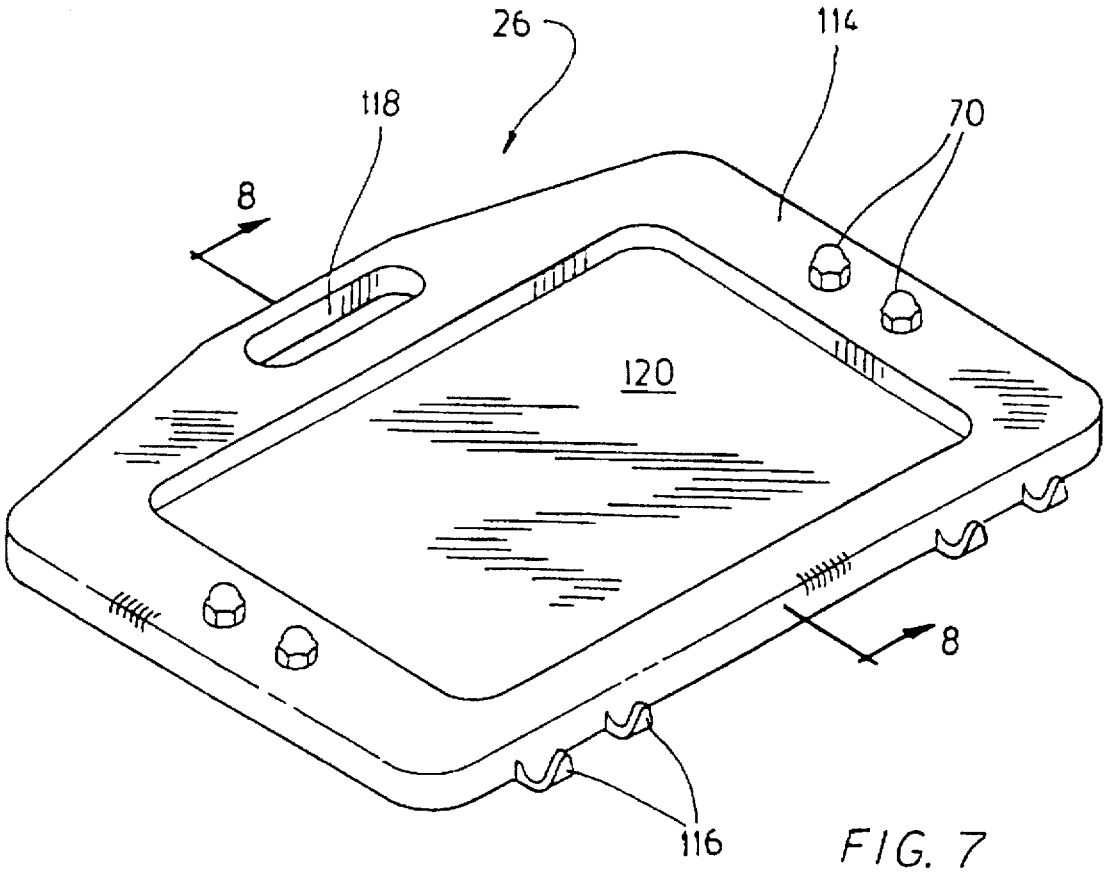
FIG. 7 is a perspective of an embodiment of a seat or tray.
Figure 8:
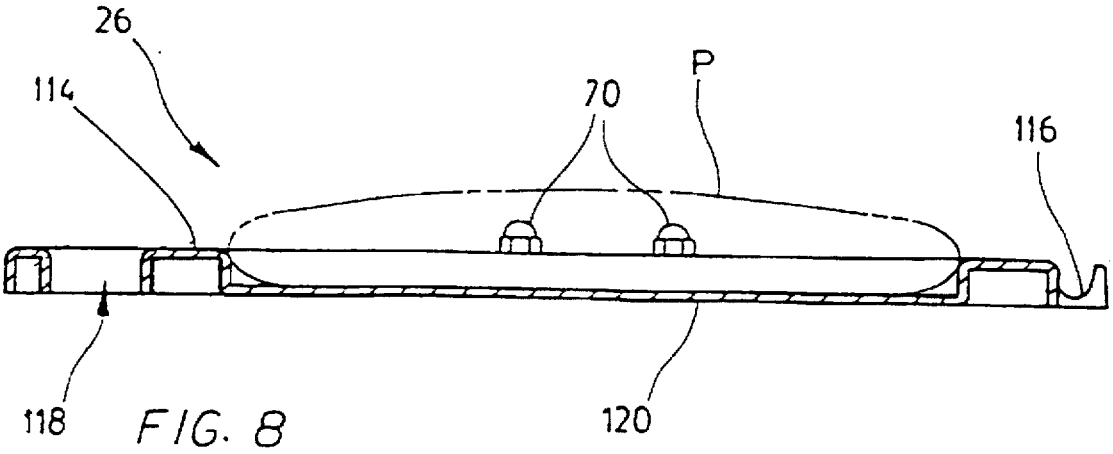
FIG. 8 is a section along line 8—8 of FIG. 7.

As shown in FIGS. 7 and 8, the seat or tray 26, in this embodiment, is of one piece moulded construction. It has a rectangular frame 114, having hooks 116, on one edge, and a handle 118 on the other. A central depression 120 is defined by frame 114, for receiving a pad P (phantom in FIG. 8). Bolts 70 secure the seat to the hinge assemblies as before.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A walking aid for physically challenged persons having two front and back leg assemblies, each leg assembly having a front leg extending forwardly and downwardly and a rear leg extending rearwardly and downwardly and wheel means at lower ends of the legs and comprising;

hinge means at upper ends of each of said leg assemblies for swinging thereof, each hinge means having;

bearing housing means for respective said hinge means each bearing housing means defining respective front and rear semi-circular bearing recesses, spaced apart from one another and defining separate axes of rotation, and pairs of respective front and rear bearing body means, each said bearing body means being received in a respective said bearing recess;

connection means on each said bearing body means, interengagable with respective said front and rear legs;

a pair of upwardly extending steering arm means, connected with respective front legs, and, transverse assembly bar means, defining two ends, a said end being connected to a respective one of said hinge means, thereby mounting and securing said hinge means in spaced apart side by side relation.

2. A walking aid as claimed in claim 1 wherein said transverse assembly bar means is provided with releasable fastening means at each end, whereby the same may be dismantled and released from said hinge means for shipping.

3. A walking aid as claimed in claim 1 wherein said hinge means include a hinge mounting frame supporting said bearing housing means and defining a forward and rearward axis, and a connecting shoe formed on said hinge mounting frame, extending normal to said longitudinal axis, for connecting with said transverse assembly bar means.

4. A walking aid as claimed in claim 1 wherein said bearing body means define recesses therein co-axial with said connection means.

5. A walking aid as claimed in claim 1 wherein said connection means define radial abutments extending from said bearing body means.

6. A walking aid as claimed in claim 1 wherein said front bearing recesses define upper opening means for receiving said steering arm means.

7. A walking aid as claimed in claim 1 including transverse back support bar means connected to said rear bearing body means.

8. A walking aid as claimed in claim 7 wherein said rear bearing recesses define upward openings for reception of said back support bar means.

9. A walking aid as claimed in claim 3 including transverse connection abutments formed on said bearing housing means and extending co-axial within said connecting shoe on said hinge mounting frame.

10. A walking aid as claimed in claim 1 and including;

a seat platform connected between said hinge means, for providing seating for a person; and a back support bar connected to each said hinge means and extending transversely across said walking aid, for supporting the back of a person when seated on said seat platform.

11. A walking aid having front and rear legs as claimed in claim 10 wherein the back support bar is of generally flattened U-shape and defines side portions connecting with said hinge means, and a cross portion for supporting the back.

12. A walking aid having a braking means and comprising;

walking handles of two part in line construction, said handles in turn comprising;

a first handle part being rigid;

a second handle part of each handle being an endwise in line extension of said first handle part and being moveable relative to said first handle part to apply said braking means, and, brake locking means on said first handle part of at least one of said walking handles, said brake locking means being moveable to lock said moveable second handle part of said at least one walking handle for locking said braking means when they are applied, and being manually releasable.

13. A walking aid as claimed in claim 12 wherein said locking means comprise a slide bar interengagable with a cam on said second handle part, and a locking lever interengagable with said slide bar.

14. A walking aid as claimed in claim 13 wherein said cam defines a peripheral groove, and a flexible brake cable received in said groove.

15. A walking aid for physically challenged persons comprising;

two front and back leg assemblies, each leg assembly having a front leg extending forwardly and a rear leg extending rearwardly and wheel means at lower ends of the legs;

front and rear hinge means at upper ends of said leg assemblies;

bearing housing means in each hinge means defining two generally semi-circular bearing recesses, spaced apart from one another and defining separate axes of rotation;

releasable connection means on each said hinge means, interengagable with respective said front and rear legs;

a pair of upwardly extending steering arm means, releasably connected to said front hinge means, and, transverse bar means, defining two ends, respective said ends being releasably connected to a respective said hinge means, thereby mounting and securing said hinge means in spaced apart side by side relation.

16. A walking aid as claimed in claim 15 and including two bearing body means, each said bearing body means being received in a respective said recess.

* * * * *